US007926384B2

(12) United States Patent
Wurn

(10) Patent No.: US 7,926,384 B2
(45) **Date of Patent: *Apr. 19, 2011**

(54) ACCELERATOR PEDAL FOR MOTORIZED VEHICLE

(75) Inventor: Michael L. Wurn, Osceola, IN (US)

(73) Assignee: CTS Corporation, Elkhart, IN (US)

( * ) Notice: Subject to any disclaimer, the term of this patent is extended or adjusted under 35 U.S.C. 154(b) by 156 days.

This patent is subject to a terminal disclaimer.

(21) Appl. No.: 12/215,123

(22) Filed: Jun. 25, 2008

(65) Prior Publication Data

US 2009/0007717 A1 Jan. 8, 2009

Related U.S. Application Data

(63) Continuation of application No. 10/854,837, filed on May 27, 2004, now Pat. No. 7,404,342.

(60) Provisional application No. 60/474,135, filed on May 29, 2003.

(51) Int. Cl.
*G05G 1/30* (2008.04)

(52) U.S. Cl. ..... 74/513

(58) Field of Classification Search ..... 74/512, 74/513, 560

See application file for complete search history.

(56) References Cited

U.S. PATENT DOCUMENTS

| | | | |
|---|---|---|---|
| 1,700,643 | A | 1/1929 | Nordell |
| 1,747,083 | A | 2/1930 | Ries |
| 4,944,269 | A | 7/1990 | Imoehl |
| RE34,302 | E | 7/1993 | Imoehl |
| 5,408,899 | A | 4/1995 | Stewart |
| 5,524,589 | A | 6/1996 | Kikkawa et al. |
| 5,697,260 | A | 12/1997 | Rixon et al. |
| 5,868,040 | A | 2/1999 | Papenhagen et al. |
| 5,937,707 | A | 8/1999 | Rixon et al. |
| 6,003,404 | A | 12/1999 | Hannewald |
| 6,070,490 | A | 6/2000 | Aschoff et al. |
| 6,073,610 | A | 6/2000 | Matsumoto et al. |
| 6,098,971 | A | 8/2000 | Stege |
| 6,158,299 | A | 12/2000 | Czajkowski |
| 6,289,762 | B1 | 9/2001 | Silva |
| 6,330,838 | B1 | 12/2001 | Kalsi |
| 6,336,377 | B1 | 1/2002 | Reimann et al. |
| 6,360,631 | B1 | 3/2002 | Wortmann et al. |
| 6,426,619 | B1 | 7/2002 | Pfaffenberger et al. |

(Continued)

FOREIGN PATENT DOCUMENTS

DE 44 07 005 C1 3/1995

(Continued)

*Primary Examiner* — Vicky A Johnson
(74) *Attorney, Agent, or Firm* — Daniel J. Deneufbourg

(57) ABSTRACT

An accelerator pedal assembly that provides a hysteresis in pedal force-response upon actuation is provided. The accelerator pedal assembly includes a housing, an elongated pedal arm terminating at one end in a rotatable drum defining a curved braking surface, a brake pad having a curved contact surface substantially complementary to the braking surface and a bias spring device operably situated between the pedal arm and the brake pad. The pedal arm is rotatably mounted to the housing such that the curved braking surface rotates as the pedal moves. The brake pad defines a primary pivot axis and is pivotably mounted for frictional engagement with the braking surface. The bias spring serves to urge the contact surface of the brake pad into frictional engagement with the braking surface of the drum.

19 Claims, 8 Drawing Sheets

U.S. PATENT DOCUMENTS

| | | | |
|---|---|---|---|
| 6,446,526 | B2 | 9/2002 | Reimann et al. |
| 6,474,191 | B1 | 11/2002 | Campbell |
| 6,523,433 | B1 | 2/2003 | Staker |
| 6,553,863 | B1 | 4/2003 | Djordjevic |
| 6,658,963 | B2 | 12/2003 | Yadehige |
| 6,718,845 | B2 | 4/2004 | Menzies |
| 6,725,741 | B2 | 4/2004 | Menzies |
| 6,745,642 | B2 | 6/2004 | Kumamoto et al. |
| 6,758,114 | B2 | 7/2004 | Sundaresan et al. |
| 6,860,170 | B2 | 3/2005 | DeForest |
| 7,404,342 | B2 * | 7/2008 | Wurn ..... 74/512 |
| 2007/0137400 | A1 * | 6/2007 | Campbell ..... 74/513 |

FOREIGN PATENT DOCUMENTS

| | | | |
|---|---|---|---|
| DE | 197 01 637 | | 7/1998 |
| EP | 0 748 713 | A2 | 12/1996 |
| EP | 0 974 886 | | 1/2000 |
| EP | 1 154 346 | | 11/2001 |
| WO | WO 01/81110 | A1 | 11/2001 |

* cited by examiner

ACCELERATOR PEDAL FOR MOTORIZED VEHICLE

CROSS-REFERENCE TO RELATED AND CO-PENDING APPLICATIONS

This application is a continuation application which claims the benefit of U.S. patent application Ser. No. 10/854,837 filed on May 27, 2004 now U.S. Pat. No. 7,404,342, entitled Accelerator Pedal for Motorized Vehicle, and U.S. Provisional Application Ser. No. 60/474,135 filed on May 29, 2003, entitled Accelerator Pedal for Motorized Vehicle, the disclosures of which are explicitly incorporated by reference, as are all references cited therein.

FIELD OF THE INVENTION

This invention relates to a pedal mechanism. In particular, the pedal may be an accelerator pedal in a vehicle.

BACKGROUND OF THE INVENTION

Automobile accelerator pedals have conventionally been linked to engine fuel subsystems by a cable, generally referred to as a Bowden cable. While accelerator pedal designs vary, the typical return spring and cable friction together create a common and accepted tactile response for automobile drivers. For example, friction between the Bowden cable and its protective sheath otherwise reduce the foot pressure required from the driver to hold a given throttle position. Likewise, friction prevents road bumps felt by the driver from immediately affecting throttle position.

Efforts are underway to replace the mechanical cable-driven throttle systems with a more fully electronic, sensor-driven approach. With the fully electronic approach, the position of the accelerator pedal is read with a position sensor and a corresponding position signal is made available for throttle control. A sensor-based approach is especially compatible with electronic control systems in which accelerator pedal position is one of several variables used for engine control.

Although such drive-by-wire configurations are technically practical, drivers generally prefer the feel, i.e., the tactile response, of conventional cable-driven throttle systems. Designers have therefore attempted to address this preference with mechanisms for emulating the tactile response of cable-driven accelerator pedals. For example, U.S. Pat. No. 6,360,631 Wortmann et al. is directed to an accelerator pedal with a plunger subassembly for providing a hysteresis effect.

In this regard, prior art systems are either too costly or inadequately emulate the tactile response of conventional accelerator pedals. Thus, there continues to be a need for a cost-effective, electronic accelerator pedal assembly having the feel of cable-based systems.

SUMMARY

The accelerator pedal assembly includes a housing, an elongated pedal arm terminating at one end in a rotatable drum defining a curved braking surface, a brake pad having a curved contact surface substantially complementary to the braking surface and a bias spring device operably situated between the pedal arm and the brake pad. The pedal arm is rotatably mounted to the housing such that the curved braking surface rotates as the pedal moves between an idle position to an open throttle position. The brake pad defines a primary pivot axis and is pivotably mounted for frictional engagement with the braking surface. The bias spring serves to urge the contact surface of the brake pad into frictional engagement with the braking surface of the drum.

In a preferred embodiment, the pedal arm carries a magnet and a Hall effect position sensor is secured to the housing and responsive to the movement of the magnet for providing an electrical signal representative of pedal displacement.

These and other objects, features and advantages will become more apparent in light of the text, drawings and claims.

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
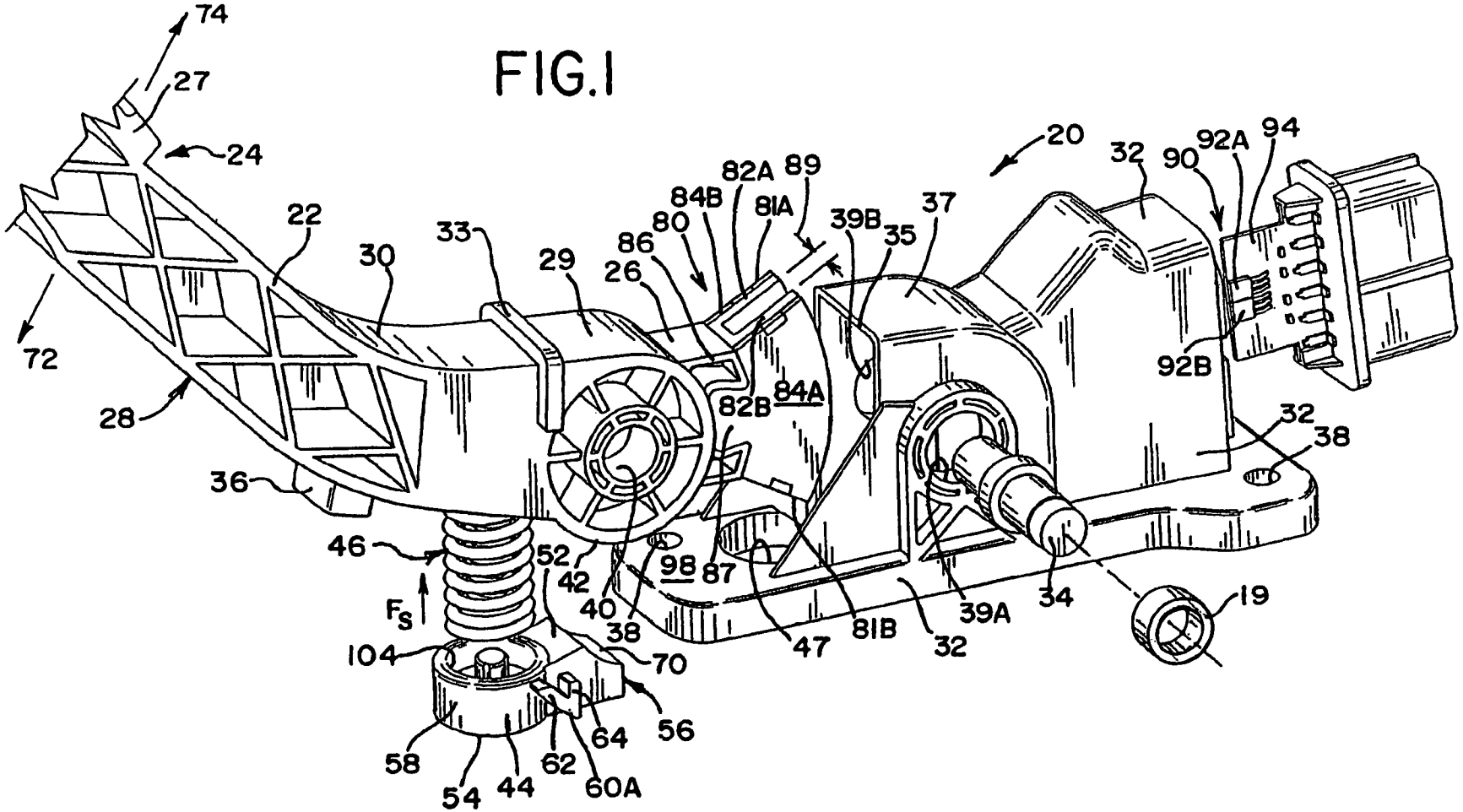
FIG. 1 is an exploded isometric view of the accelerator pedal assembly of the present invention.

Referring to FIG. 1, a non-contacting accelerator pedal assembly 20 according to the present invention includes a housing 32, a pedal arm 22 rotatably mounted to housing 32, a brake pad 44 and a bias spring device 46. The labels "pedal beam" or "pedal lever" also apply to pedal arm 22. Likewise, brake pad 44 may be referred to as a "body" or "braking lever." Pedal arm 22 has a footpad 27 at one end and terminates at its opposite proximal end 26 in a drum portion 29 that presents a curved, convex braking (or drag) surface 42. Pedal arm 22 has a forward side 28 nearer the front of the car and a rearward side 30 nearer the driver and rear of the car. Footpad 27 may be integral with the pedal lever 22 or articulating and rotating at its connection at the lower end 24. Braking surface 42 of accelerator arm 22 preferably has the curvature of a circle of a radius R1 which extends from the center of opening 40. A non-circular curvature for braking surface is also contemplated. In the preferred embodiment, as illustrated, surface 42 is curved and convex with a substantially constant radius of curvature. In alternate embodiments, surface 42 has a varying radius of curvature.

Pedal arm 22 pivots from housing 32 via an axle connection through drum 29 such that drum 29 and its contact surface 42 rotate as pedal arm 22 is moved. Spring device 46 biases pedal arm 22 towards the idle position. Brake pad 44 is positioned to receive spring device 46 at one end and contact drum 29 at the other end. Brake pad 44 is pivotally mounted to housing 32 such that a contact surface 70 is urged against braking surface 42 as pedal arm 22 is depressed.

Pedal arm 22 carries a magnet subassembly 80 for creating a magnetic field that is detected by redundant Hall effect sensors 92A and 92B which are secured in housing 32. Acting together, magnet 80 and sensors 92 provide a signal representative of pedal displacement.

It should be understood that a Hall effect sensor with magnet is representative of a number of sensor arrangements available to measure the displacement of pedal arm 22 with respect to housing 32 including other optical, mechanical, electrical, magnetic and chemical means. Specifically contemplated is a contacting variable resistance position sensor.

In a preferred embodiment as illustrated, housing 32 also serves as a base for the mounted end 26 of pedal arm 22 and for sensors 92. Proximal end 26 of pedal arm 22 is pivotally secured to housing 32 with axle 34. More specifically, drum portion 29 of pedal arm 22 includes an opening 40 for receiving axle 34, while housing 32 has a hollow portion 37 with corresponding openings 39A and 39B also for receiving axle 34. Axle 34 is narrowed at its ends where it is collared by a bearing journal 19.

In addition to contact surface 70, the other features of brake pad 44 include a top 52 which is relatively flat, a bottom 54 which consists of two flat planes 114 and 112 intersecting to a ridge 110, a front face 56 which is substantially flat, and a circular back face 58.

Brake pad 44 also has opposed trunnions 60A and 60B (also called outriggers or flanges) to define a primary pivot axis positioned between spring device 46 and contact surface 70. Contact surface 70 of brake pad 44 is situated on one side of this pivot axis and a donut-shaped socket 104 for receiving one end of bias spring 46 is provided on the other side.

Contact surface 70 is substantially complementary to braking surface 42. In the preferred embodiment, as illustrated, contact surface 70 is curved and concave with a substantially constant radius of curvature. In alternate embodiments, braking surface has a varying radius of curvature. The frictional engagement between contact surface 70 and braking surface 42 may tend to wear either surface. The shape of contact surface 42 may be adapted to reduce or accommodate wear.

Referring now also to FIGS. 2 through 6, housing 32 is provided with spaced cheeks 66 for slidably receiving the trunnions 60A and 60B. Trunnions 60A and 60B are substantially U-shaped and have an arc-shaped portion 62 and a rectilinear (straight) portion 64. Brake pad 44 pivots over cheeks 66 at trunnions 60A and 60B.

As pedal arm 22 is moved in a first direction 72 (accelerate) or the other direction 74 (decelerate), the force $F_s$ within compression spring 46 increases or decreases, respectively. Brake pad 44 is moveable in response to the spring force $F_s$.

Figure 4:
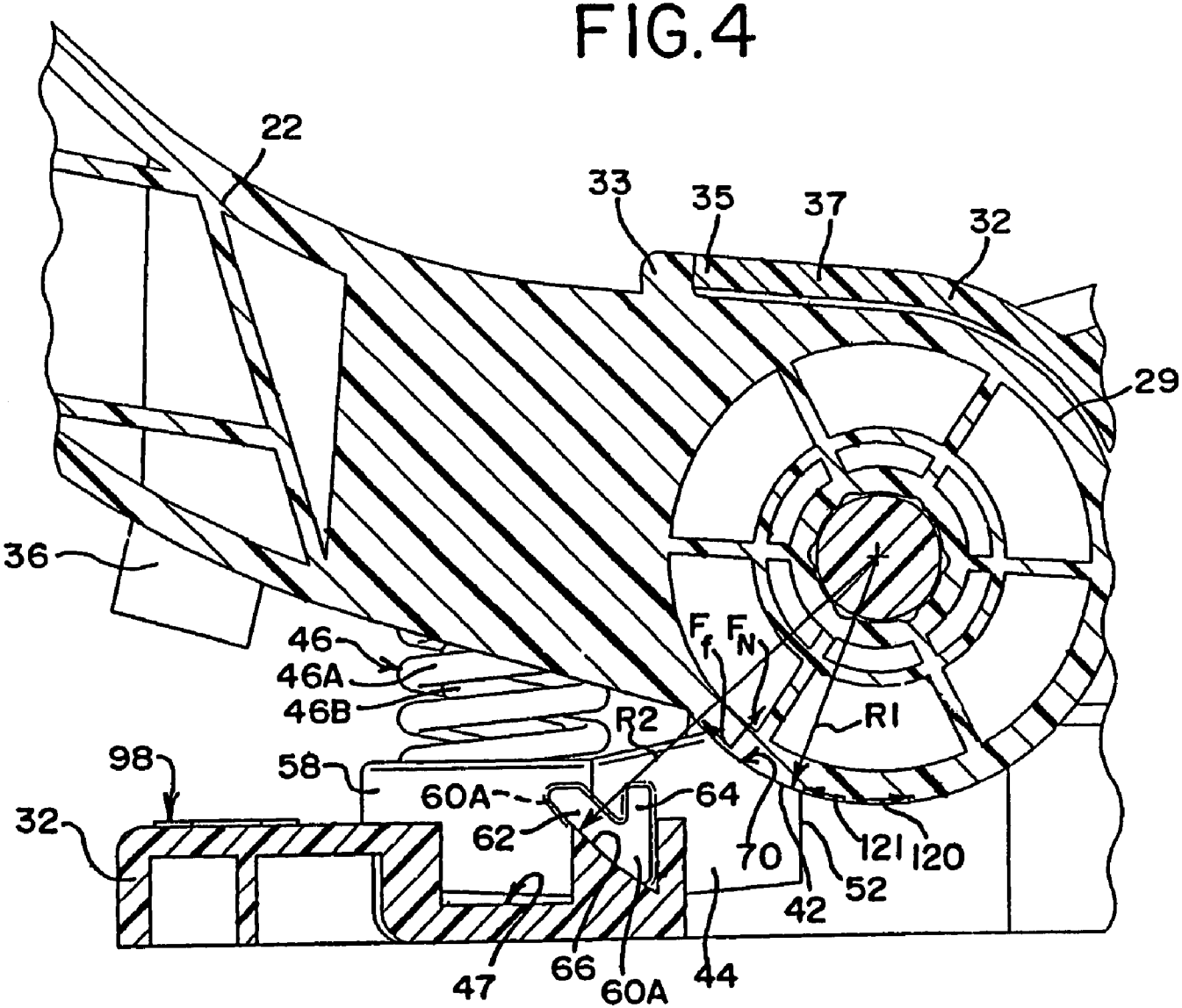
FIG. 4 is an enlarged side, cross-sectional view of the accelerator pedal assembly according to the present invention.
Figure 5:
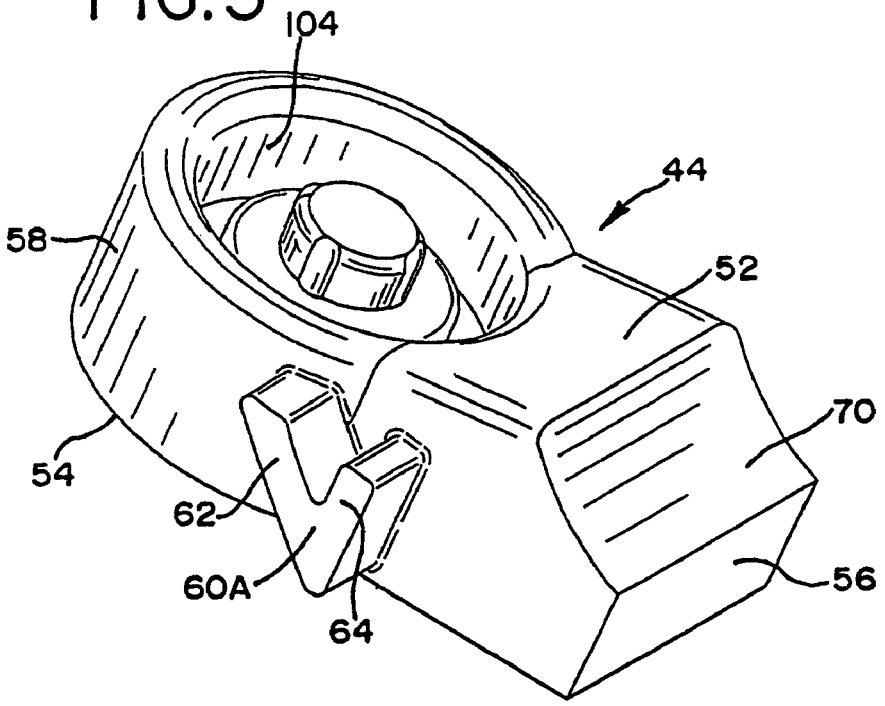
FIG. 5 is an isometric view of the break pad part of the accelerator pedal assembly.

As pedal arm 22 moves towards the idle/decelerate position (direction 74), the resulting drag between braking surface 42 and contact surface 70 urges brake pad 44 towards a position in which trunnions 60A and 60B are higher on cheeks 66. This change in position is represented with phantom trunnions in FIG. 4. Although FIG. 4 depicts a change in position with phantom trunnions to aid in understanding the invention, movement of brake pad 44 may not be visibly detectable. As pedal arm 22 is depressed (direction 72), the drag between braking surface 42 and contact surface 70 draws brake pad 44 further into hollow portion 37. The sliding motion of brake pad 44 is gradual and can be described as a "wedging" effect that either increases or decreases the force urging contact surface 70 into braking surface 42. This directionally dependent hysteresis is desirable in that it approximates the feel of a conventional mechanically-linked accelerator pedal.

When pedal force on arm 22 is increased, brake pad 44 is urged forward on cheeks 66 by the frictional force created on contact surface 70 as braking surface 42 rotates forward (direction 120 in FIG. 4). This urging forward of brake pad 44 likewise urges trunnions 60A and 60B lower on cheeks 66 such that the normal, contact force of contact surface 70 into braking surface 42 is relatively reduced.

When pedal force on arm 22 is reduced, the opposite effect is present: the frictional, drag force between 44 and braking surface 42 urges brake pad 44 backward on cheeks 66 (direction 121 in FIG. 4). This urging backward of brake pad 44 urges trunnions 60A and 60B higher on cheeks 66 such that the normal-direction, contact force between braking surface 42 and contact surface 70 is relatively increased. The relatively higher contact force present as the pedal force on arm 22 decreases allows a driver to hold a given throttle position with less pedal force than is required to move the pedal arm for acceleration.

Bias spring device 46 is situated between a hollow 106 (FIG. 3) in pedal lever 22 and a receptacle 104 on brake pad 44. Spring device 46 includes two, redundant coil springs 46A and 46B in a concentric orientation, one spring nestled within the other. This redundancy is provided for improved reliability, allowing one spring to fail or flag without disrupting the biasing function. It is preferred to have redundant springs and for each spring to be capable—on its own—of returning the pedal lever 22 to its idle position.

Figure 6:
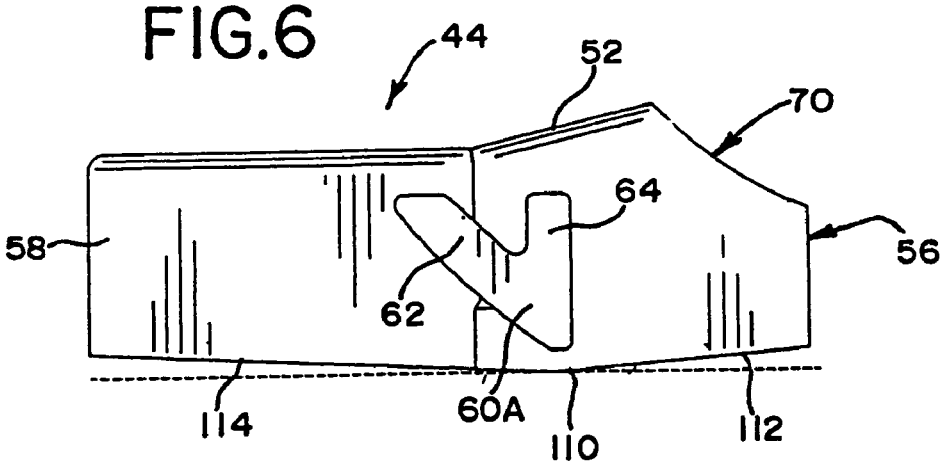
FIG. 6 is a side view of the break pad of the accelerator pedal assembly.
Figure 7:
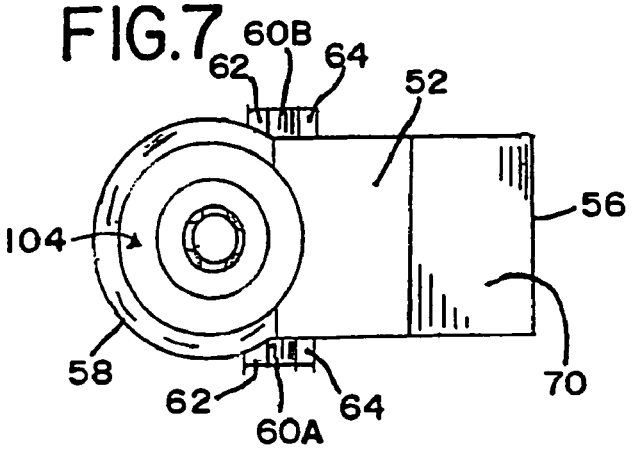
FIG. 7 is a top, plan view of the break pad of the accelerator pedal assembly.

Also for improved reliability, brake pad 44 is provided with redundant pivoting (or rocking) structures. In addition to the primary pivot axis defined by trunnions 60A and 60B, brake pad 44 defines a ridge 110 which forms a secondary pivot axis, as best shown in FIG. 6. When assembled, ridge 110 is juxtaposed to a land 47 defined in housing 32. Ridge 110 is formed at the intersection of two relatively flat plane portions at 112 and 114. The pivot axis at ridge 110 is substantially parallel to, but spaced apart from, the primary pivot axis defined by trunnions 60A and 60B and cheeks 60.

The secondary pivot axis provided by ridge 110 and land 47 is a preferred feature of accelerator pedals according to the present invention to allow for failure of the structural elements that provide the primary pivot axis, namely trunnions 60A and 60B and cheeks 66. Over the useful life of an automobile, material relaxations, stress and or other aging type changes may occur to trunnions 60A and 60B and cheeks 66. Should the structure of these features be compromised, the pivoting action of brake pad 44 can occur at ridge 110.

Pedal arm 22 has predetermined rotational limits in the form of an idle, return position stop 33 on side 30 and a depressed, open-throttle position stop 36 on side 28. When pedal arm 22 is fully depressed, stop 36 comes to rest against portion 98 of housing 32 and thereby limits forward movement. Stop 36 may be elastomeric or rigid. Stop 33 on the opposite side 30 contacts a lip 35 of housing 32.

Housing 32 is securable to a wall via fasteners through mounting holes 38. Pedal assemblies according to the present invention are suitable for both firewall mounting or pedal rack mounting by means of an adjustable or non-adjustable position pedal box rack.

Figure 2:
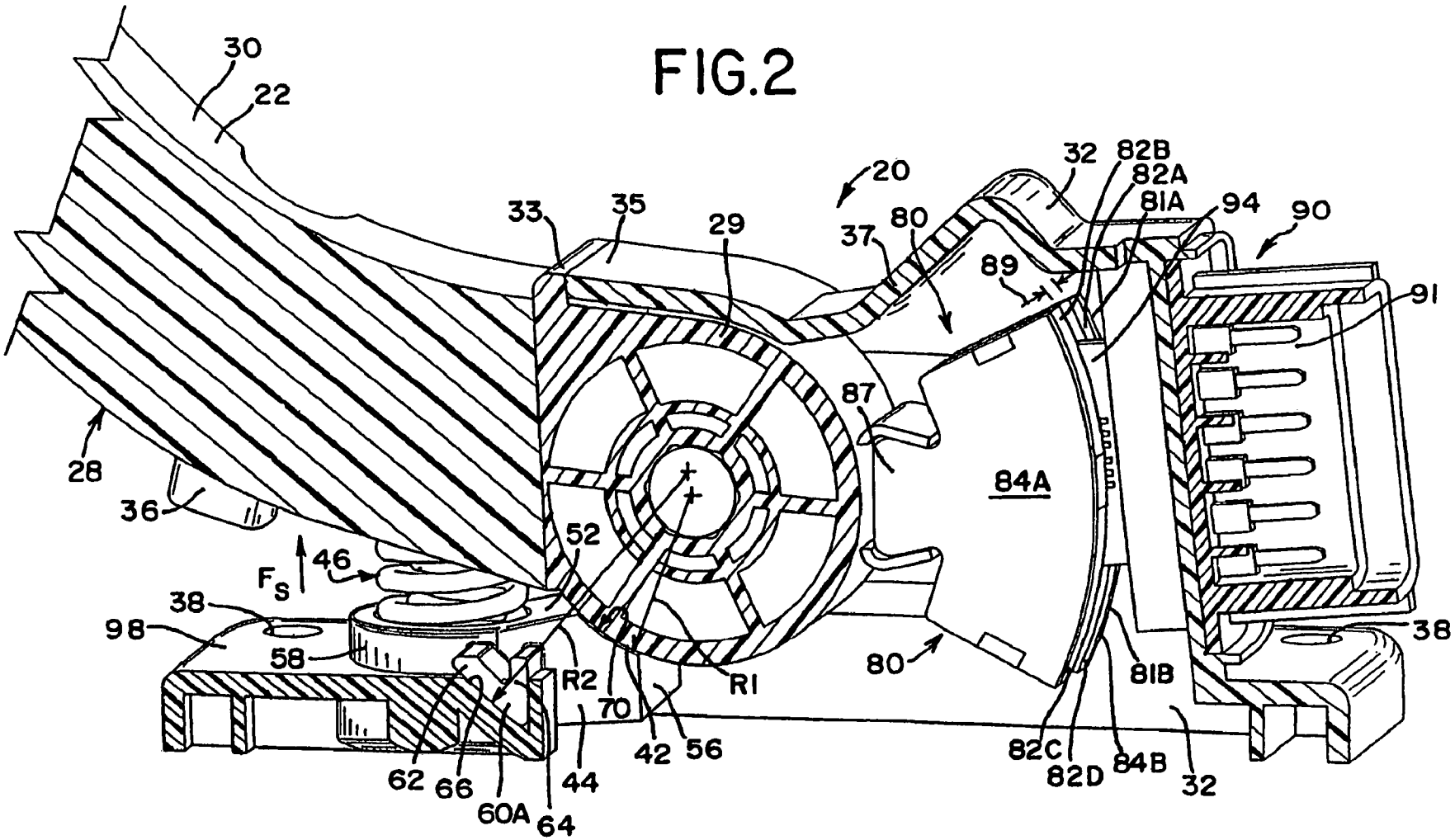
FIG. 2 is an enlarged cross-sectional view of the accelerator pedal assembly shown in FIG. 1.
Figure 3:
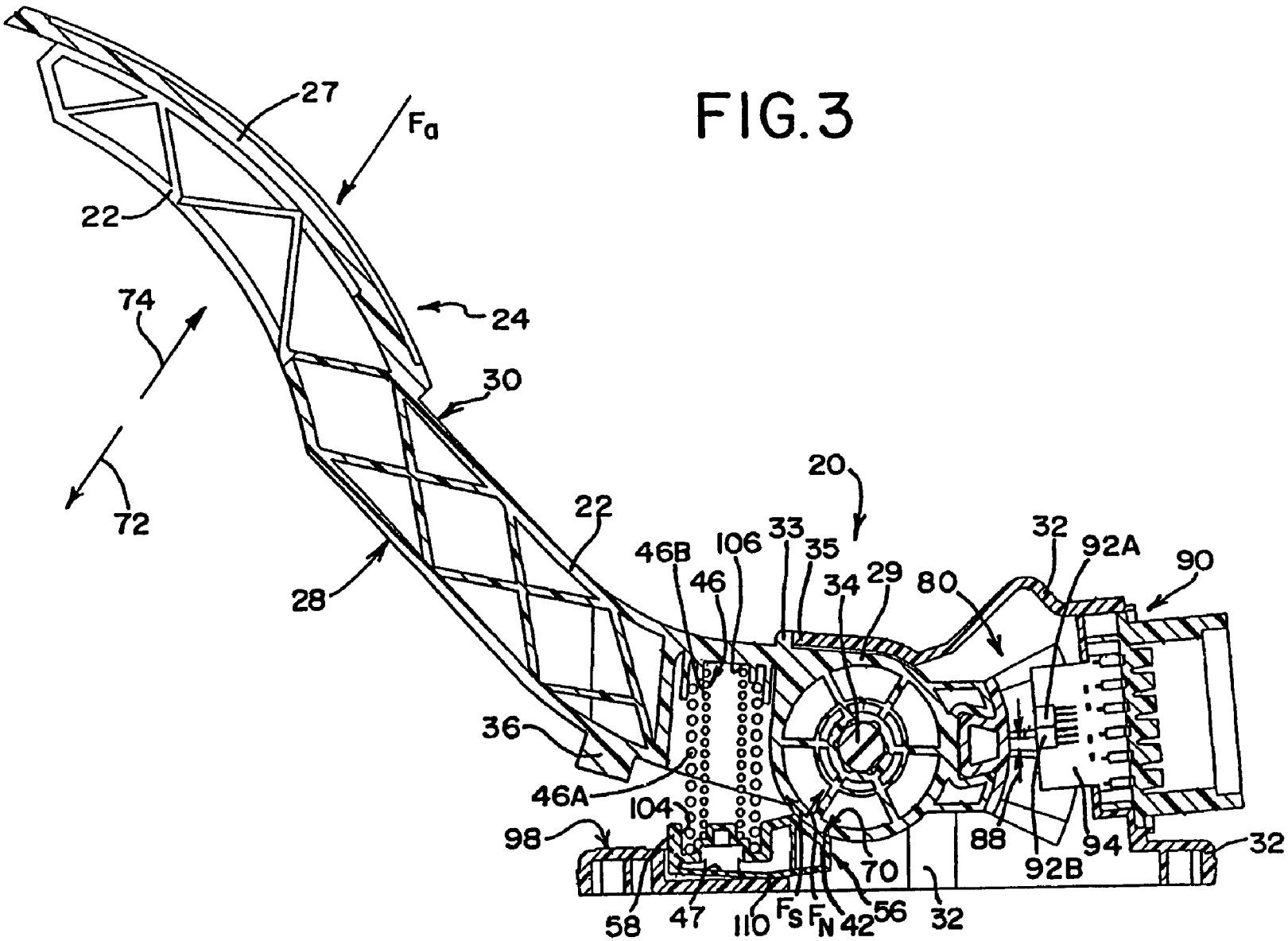
FIG. 3 is a cross-sectional view of the accelerator pedal assembly showing the foot pedal and Hall effect position sensors.

Magnet assembly 80 has opposing fan-shaped sections 81A and 81B, and a stem portion 87 that is held in a two-pronged plastic grip 86 extending from drum 29. Assembly 80 preferably has two major elements: a specially shaped, single-piece magnet 82 and a pair of (steel) magnetic flux conductors 84A and 84B. Single-piece magnet 82 has four alternating (or staggered) magnetic poles: north, south, north, south, collectively labeled with reference numbers 82A, 82B, 82C, 82D as best seen in FIG. 2. Each pole 82A, 82B, 82C, 82D is integrally formed with stem portion 87 and separated by air gaps 89 (FIG. 1) and 88 (FIG. 3). Magnetic flux flows from one pole to the other—like charge arcing the gap on a spark plug—but through the magnetic conductor 84. A zero gauss point is located at about air gap 88.

Magnetic field conductors 84A and 84B are on the outsides of the magnet 82, acting as both structural, mechanical support to magnet 82 and functionally tending to act as electromagnetic boundaries to the flux the magnet emits. Magnetic field conductors 84 provide a low impedance path for magnetic flux to pass from one pole (e.g., 82A) of the magnet assembly 80 to another (e.g., 82B).

As best shown in FIG. 2, sensor assembly 90 is mounted to housing 32 to interact with magnet assembly 80. Sensor assembly 90 includes a circuit board portion 94 received within the gap 89 between opposing magnet sections 81A and 81B, and a connector socket 91 for receiving a wiring harness connector plug.

Circuit board 94 carries a pair of Hall Effect sensors 92A and 92B. Hall effect sensors 92 are responsive to flux changes induced by pedal arm lever displacement and corresponding rotation of drum 29 and magnet assembly 80. More specifically, Hall effect sensors 92 measure magnet flux through the magnet poles 82A and 82B. Hall effect sensors 92 are operably connected via circuit board 94 to connector 91 for providing a signal to an electronic throttle control. Only one Hall effect sensor 92 is needed but two allow for comparison of the readings between the two Hall effect sensors 82 and consequent error correction. In addition, each sensor serves as a back up to the other should one sensor fail.

Electrical signals from sensor assembly 90 have the effect of converting displacement of the foot pedal 27, as indicated by displacement of the magnet 82, into a dictated speed/acceleration command which is communicated to an electronic control module such as is shown and described in U.S. Pat. Nos. 5,524,589 to Kikkawa et al. and 6,073,610 to Matsumoto et al. hereby incorporated expressly by reference.

Referring to FIGS. 2 and 3, it is a feature of the present invention that the preferably circular contours of contact surface 70 and trunnion portion 62 can be aligned concentrically or eccentrically. A concentric alignment as illustrated in FIG. 4, with reference labels R1 and R2, results in a more consistent force $F_N$ applied between surface 42 and surface face 70 as pedal arm 22 is actuated up or down. An eccentric, alignment as illustrated in FIG. 2, tends to increase the hysteresis effect. In particular, the center of the circle that traces the contour of the surface 70 is further away from the firewall in the rearward direction 74.

The effect of this eccentric alignment is that depression of the footpad 27 leads to an increasing normal force $F_N$ exerted by the contact surface 70 against braking surface 42. A friction force $F_f$ between the surface 70 and surface 42 is defined by the coefficient of dynamic friction multiplied by normal force $F_N$. As the normal force $F_N$ increases with increasing applied force $F_a$ at footpad 27, the friction force $F_f$ accordingly increases. The driver feels this increase in his/her foot at footpad 27. Friction force $F_f$ runs in one of two directions along face 70 depending on whether the pedal lever is pushed forward 72 or rearward 74. The friction force $F_f$ opposes the applied force $F_a$ as the pedal is being depressed and subtracts from the spring force $F_s$ as the pedal is being returned toward its idle position.

FIGS. 8A, 8B, 8C, 8D contain a force diagram demonstrating the directionally dependent actuation-force hysteresis provided by accelerator pedal assemblies according to the present invention. In FIGS. 8A through 8D, the y-axis represents the foot pedal force $F_a$ required to actuate the pedal arm, in Newtons (N). The x-axis is displacement of the footpad 27. Path 150 represents the pedal force required to begin depressing pedal arm 22. Path 152 represents the relatively smaller increase in pedal force necessary to continue moving pedal arm 22 after initial displacement toward mechanical travel stop, i.e. contact between stop 36 and surface 98. Path 154 represents the decrease in foot pedal force allowed before pedal arm 22 begins movement toward idle position. This no-movement zone allows the driver to reduce foot pedal force while still holding the same accelerator pedal position. Over path 156, accelerator pedal assembly 20 is in motion as the force level decreases.

Figure 8A:
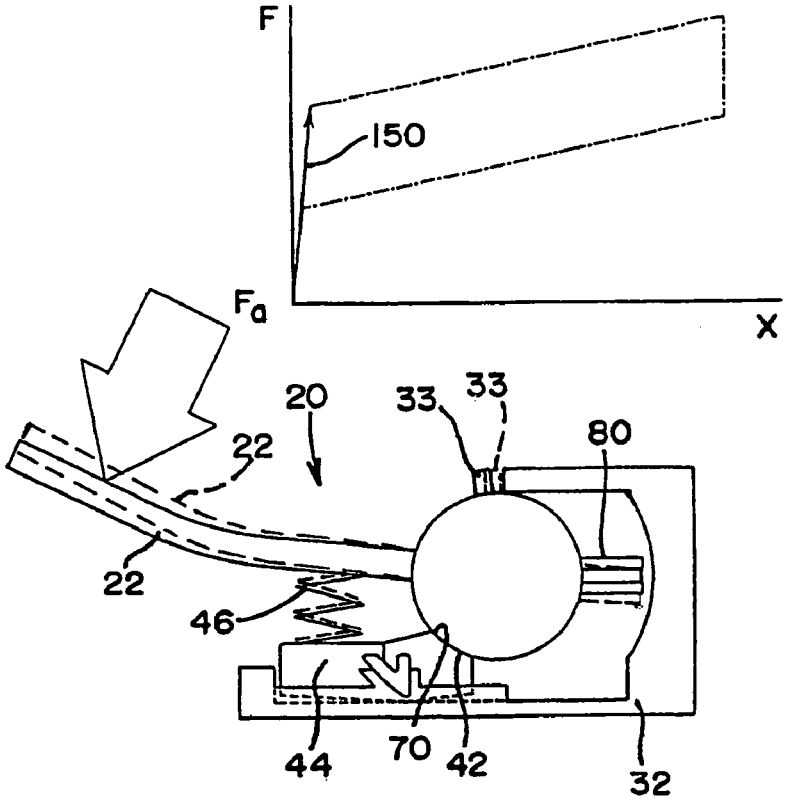
FIGS. 8A through 8D are force-displacement graphs mapped to simplified schematics illustrating the operation of accelerator pedal assemblies according to the present invention.
Figure 8B:
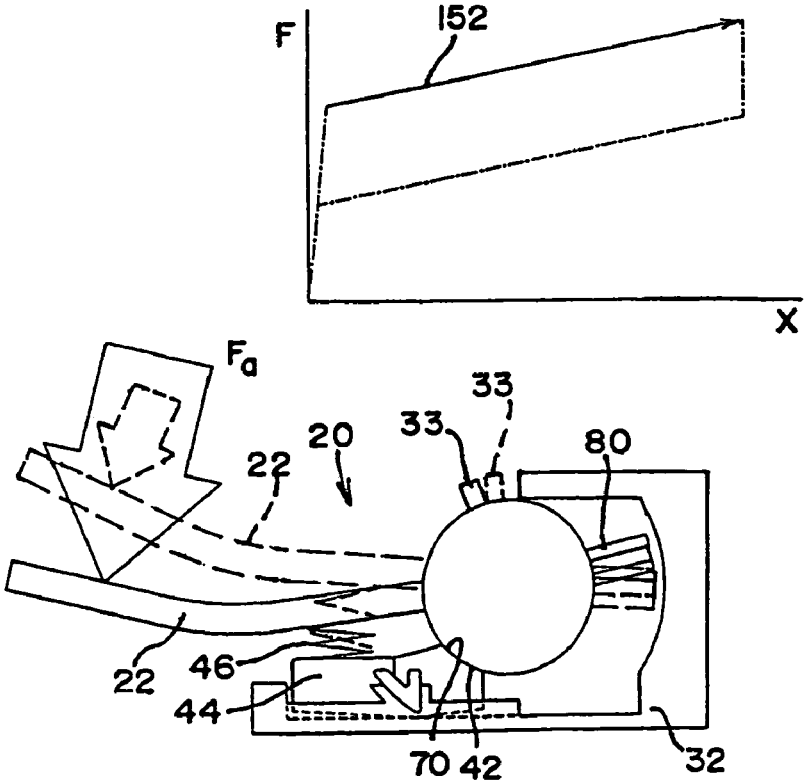
Figure 8C:
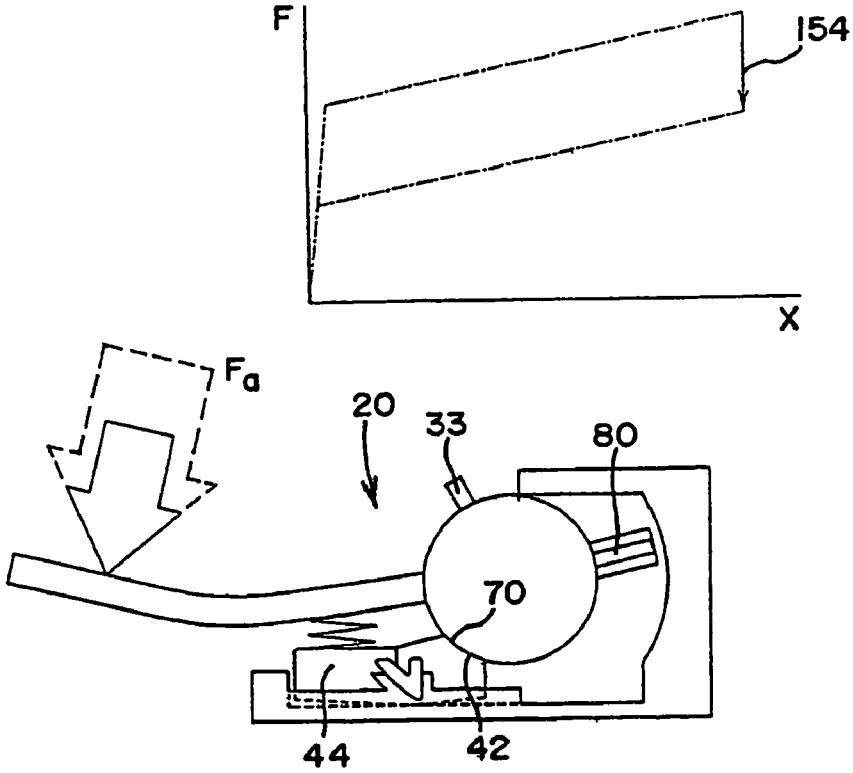
Figure 8D:
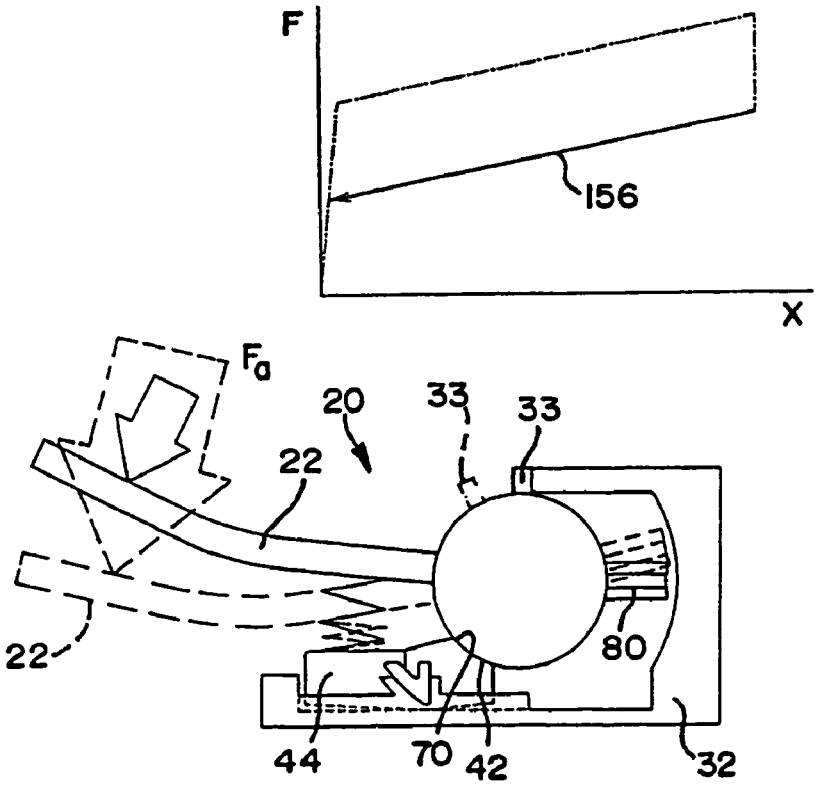

FIGS. 8A, 8B, 8C, 8D combine a force-displacement graph with simplified schematics showing selected features of accelerator pedals according to the invention. The schematic portion of FIG. 8A illustrates the status of accelerator pedal apparatus 20 for path 150 when initially depressed. FIG. 8B illustrates the status of apparatus 20 for path 152 when increasing pedal force causes relatively greater pedal displacement. FIG. 8C illustrates the status of apparatus 20 for path 154 when pedal force can decrease without pedal arm movement. Finally, FIG. 8D illustrates the status of apparatus 20 for path 156 as pedal arm 22 is allowed to return to idle position.

FIGS. 8A through 8D describe pedal operation according to the present invention over a complete cycle of actuation from a point of zero pedal pressure, i.e., idle position, to the fully depressed position and then back to idle position again with no pedal pressure. The shape of this operating curve also applies, however, to mid-cycle starts and stops of the accelerator pedal. For example, when the accelerator pedal is depressed to a mid-position, the driver still benefits from a no-movement zone when foot pedal force is reduced.

Figure 9A:
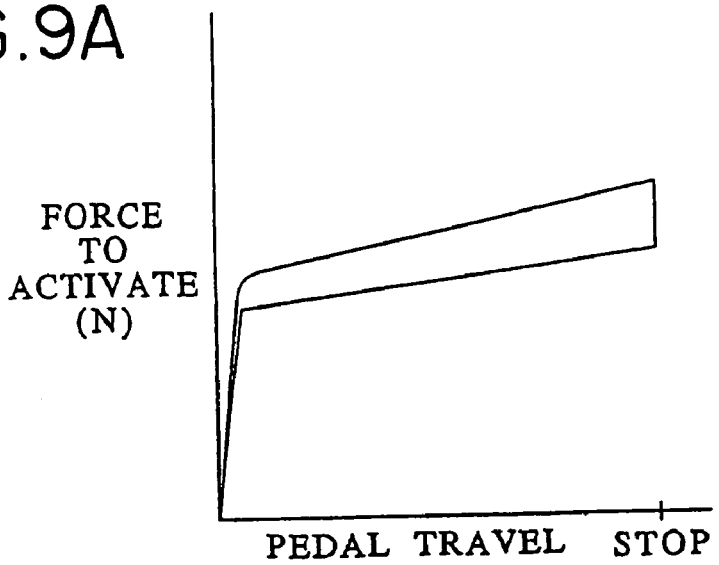
FIGS. 9A through 9C are force diagrams demonstrating the tunable tactile response of accelerator pedals according to the present invention.
Figure 9B:
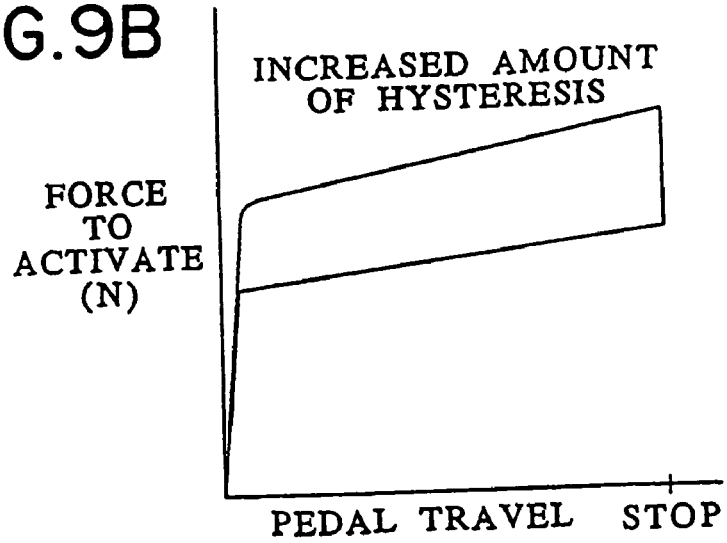
Figure 9C:
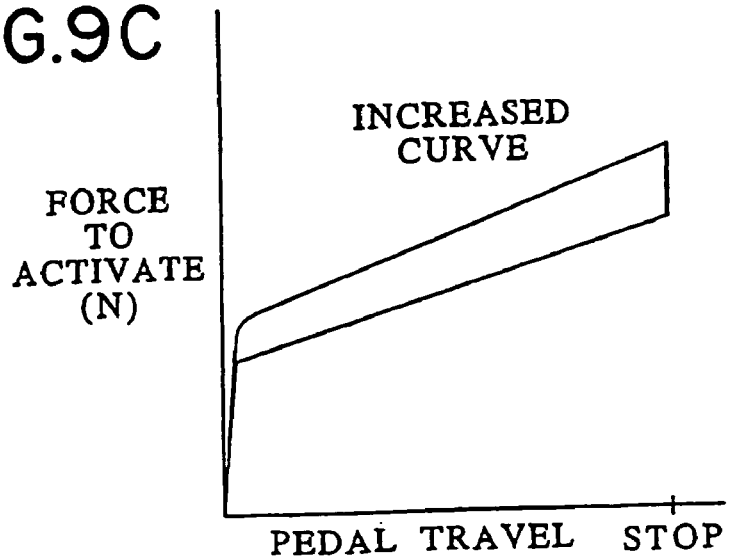

FIGS. 9A through 9C are additional force diagrams demonstrating the directionally dependent actuation-force hysteresis provided by accelerator pedal assemblies according to the present invention. FIG. 9A is a reproduction of the force diagram of FIGS. 8A through 8D for juxtaposition with FIGS. 9B and 9C.

As compared to the accelerator pedal assembly described in FIG. 9A, the assembly described by FIG. 9B offers a larger no-movement zone 154, i.e., increased hysteresis. In a preferred embodiment, pedal force can be reduced 40 to 50 percent before pedal arm 22 begins to move towards idle. FIG. 9C is the operating response for an accelerator pedal requiring a greater increase in foot pedal force to actuate the pedal arm. In other words, FIG. 9C describes an accelerator pedal according to the present invention having a relatively "stiffer" tactile feel.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

I claim:

1. A pedal assembly comprising:

a housing;

a pedal arm having a first end and a second end, the second end defining a drum that has a braking surface, the pedal arm being coupled to the housing for rotating motion;

a brake pad having a contact surface and being pivotably mounted for frictional engagement with the braking surface and defining a primary pivot axis about the housing;

a bias spring device disposed between the pedal arm and the brake pad for urging the contact surface of the brake pad into frictional engagement with the braking surface of the drum; and the brake pad having a pair of opposed flanges that define the primary pivot axis about the housing.

2. The pedal assembly in accordance with claim 1 wherein the housing defines respective recesses adapted to receive the flanges.

3. The pedal assembly in accordance with claim 2 wherein the flanges extend outwardly from the brake pad and the recesses are defined by cheeks formed on the housing.

4. The pedal assembly in accordance with claim 1 wherein the flanges are U-shaped.

5. The pedal assembly in accordance with claim 1 wherein the brake pad defines a secondary pivot axis about the housing which is spaced from the primary pivot axis.

6. The pedal assembly in accordance with claim 5 wherein the secondary pivot axis is defined by a ridge on the brake pad which contacts the housing and allows the brake pad to pivot about the housing.

7. A pedal assembly comprising:

a housing defining a cavity;

a pedal arm mounted to the housing through an axle, the pedal arm having a first end located in the cavity and a second end extending outside the housing, the first end of the pedal arm defining a drum, the pedal arm being movable between a first position and a second position;

a braking surface located on the drum;

a brake pad coupled to the housing, the brake pad having a contact surface that is adapted to move into frictional engagement with the braking surface, the brake pad including at least two outriggers extending therefrom, the outriggers engaging with the housing to allow pivotal movement of the brake pad relative to the housing; and a spring set between the pedal arm and the brake pad for urging the contact surface of the brake pad into frictional engagement with the braking surface of the drum.

8. The pedal assembly in accordance with claim 7 wherein the outriggers are adapted to be seated in respective cheeks associated with the housing.

9. The pedal assembly in accordance with claim 7 wherein the outriggers define a first axis for pivoting the brake pad about the housing.

10. The pedal assembly in accordance with claim 7 wherein the brake pad defines a second pivot axis.

11. The pedal assembly in accordance with claim 10 wherein the second pivot axis is defined by a ridge on the brake pad adapted to contact the housing.

12. The pedal assembly in accordance with claim 7 wherein a magnet is coupled to the pedal arm and a sensor is coupled to the housing.

13. The pedal assembly in accordance with claim 7 wherein the brake pad is adapted to move toward and away from the drum.

14. The pedal assembly in accordance with claim 7 wherein the pedal arm has at least one stop that abuts the housing at a predetermined rotational limit.

15. A pedal assembly comprising:

a housing;

a pedal arm rotatably mounted to the housing and defining a proxil end and a footpad end;

a rotatable drum associated with the proxil end of the pedal arm and defining a braking surface; and a brake pad defining a contact surface adapted for frictional engagement with the braking surface of the drum as the pedal arm is depressed and at least a first pivot for pivoting the brake pad about the housing.

16. The pedal assembly in accordance with claim 15 wherein the first pivot is defining by opposed flanges on the brake pad adapted for contact with the housing.

17. The pedal assembly in accordance with claim 15 wherein a first spring is coupled between the pedal arm and the brake pad.

18. The pedal assembly in accordance with claim 15 wherein the brake pad defines a second pivot for pivoting the brake pad about the housing.

19. The pedal assembly in accordance with claim 18 wherein the second pivot is defined by a ridge on the brake pad adapted for contact with the housing.

* * * * *